United States Patent [19]

Garner et al.

[11] 4,414,802

[45] Nov. 15, 1983

[54] APPARATUS FOR STRANDING WIRE

[75] Inventors: John N. Garner, Kingston; Jean M. Roberge, Pointe Claire; Douglas G. Baxter, Kingston, all of Canada

[73] Assignee: Northern Telecom Limited, Montreal, Canada

[21] Appl. No.: 413,069

[22] Filed: Aug. 30, 1982

[51] Int. Cl.[3] ..... H01B 13/04

[52] U.S. Cl. ..... 57/293; 57/332; 57/344

[58] Field of Search ..... 57/3, 6, 13, 293, 294, 57/332, 344–349

[56] References Cited

U.S. PATENT DOCUMENTS

| | | | |
|---|---|---|---|
| 3,572,024 | 3/1971 | Lyons | 57/293 X |
| 3,704,580 | 12/1972 | Blanchet et al. | 57/293 |
| 3,847,190 | 11/1974 | Forester | 57/293 X |
| 3,910,022 | 10/1975 | Reed | 57/293 |
| 4,214,432 | 7/1980 | Scheidt | 57/293 |
| 4,325,214 | 4/1982 | Zuber | 57/293 |

*Primary Examiner*—John Petrakes

*Attorney, Agent, or Firm*—R. J. Austin

[57] ABSTRACT

Wire stranding apparatus having a single tube defining a single axial passage providing at least two side-by-side feedpaths for wire, the passage being shaped to prevent wires from moving across from one feedpath to another. The tube is rotationally flexible to torsionally twist it in alternating directions by use of a twisting means at its downstream end while the upstream end is held against rotation. Change in twist direction occurs after a predetermined number of rotations of the twisting means. To accommodate axial contraction and extension during twisting, the tubular means has an axially acting resilient means which maintains axial tension in the tubular means.

3 Claims, 3 Drawing Figures

APPARATUS FOR STRANDING WIRE

This invention relates to apparatus for stranding.

It is known that the stranding of wires together offers physical and electrical advantages when the wires are individually insulated conductors as used in communications or other electrical systems. For example, the stranding of pairs of wires as used in telephone systems improves electrical characteristics such as reducing crosstalk.

Conventionally, to continuously strand wires together in the same direction requires a heavy rotatable construction as the wire spools for feeding wire into the apparatus must also revolve about the machine axis. The excessive weight of the construction limits the operational speed. In order to avoid the rotation of the spools, a periodically reversing stranding operation is performed upon the wires and as it is desirable to strand long lengths of wires in each direction, accumulators become necessary.

In order to overcome problems with known stranding apparatus, simpler apparatus has been devised to give a periodic reverse stranding operation. This simpler apparatus as described in U.S. Pat. No. 3,910,022 granted Oct. 7, 1975 in the name of Phillip John Reed and entitled "Apparatus For Stranding Wires" involves the use of a tubular member, one end of which is held stationary and the other torsionally twisted first in one direction and then the other around its longitudinal axis. Dividers positioned along the member divide the tube passage into separate paths for wires passing down the member. A twisting means at the downstream end of the tubular member twists the member by rotating the downstream end of the member for a predetermined number of revolutions, first in one direction and then the other, to torsionally twist the member in reversing member. A twist is imposed upon each wire by the twisting means and this twist causes the wires to strand together along their lengths as the wires emerge from the twisting means.

In U.S. Pat. No. 4,325,214 granted Apr. 20, 1982, in the name of Bretislav Paval Zuber and entitled "Apparatus For Stranding Wire", there is described an improvement to the Reed construction. In this patent, the tubular member is replaced by an elongate member which is held stationary at an upstream end and is rotatable at the downstream end for twisting it. The member has a plurality of wire guiding elements extending radially outwards from it, each element having wire guiding holes whereby the wires are threaded through the holes from guiding element to guiding element while being located outwards from the elongate member. While the operation of the apparatus described in the above patents are satisfactory, it has been found that there is a drag created upon the wires as they pass along their feedpaths and this drag affects the speed of throughput of the wire. This drag is created by the contact by the wires with the spaced-apart wire guiding elements or the dividers, as the case may be.

An object of the present invention is to provide an apparatus for stranding wires in which the above problem is minimized.

Accordingly, the present invention provides an apparatus for stranding wires comprising:

(a) a single tube defining a single axial passage which provides at least two side-by-side feedpaths for wire along the passage, the passage shaped to prevent wires from moving from feedpath to feedpath, the tube being rotationally flexible about an axis to torsionally twist the tube and thus the passage around said axis from an untwisted position so as to cause the feedpaths to follow a helical path around the axis;

(b) holding means to hold the tube against rotation about said axis at an upstream position of the tube;

(c) wire twisting means at the downstream position of the tube to torsionally twist the tube, the twisting means rotatable with the downstream part of the tube, said feedpaths extending through the twisting means;

(d) rotating means for rotating the twisting means together with the downstream part of the tube for a predetermined number of revolutions about the axis alternately in one direction and then the other;

(e) direction changing means to change the direction of rotation of the twisting means after the twisting means has rotated the predetermined number of revolutions in each direction; and (f) resilient means associated with one of the ends of the tube to enable movement of said one end in the axial direction during twisting and untwisting of the tube.

In the above construction, the tube may be a flattened tube having an elongated passage in a cross-section laterally of the axis. The elongate passage is of sufficient size at each side of the passage to allow a wire to pass through it, but merely creates a clearance between the wall of the tube and each wire whereby the width across the flattened portion of the tube is insufficient to enable the wires to interchange their positions. In another arrangement, the tube may be formed from two longitudinal sections each being formed in arcuate shape and in a generally 'U' configuration with the ends of the 'U' being closer together than a space defined within the 'U'. Hence, with the free ends of the two sections being jointed together, two spaces are provided by the two sections with a restriction in between them caused by the narrowing together of the free ends of the 'U' shapes. With a wire passing down each tube section of the correct size for the tube, the size of the restriction is insufficient to enable one wire to pass from one side of the tube to the other.

Embodiments of the invention will now be described by way of example, with reference to the accompanying drawings in which.

Figure 1:
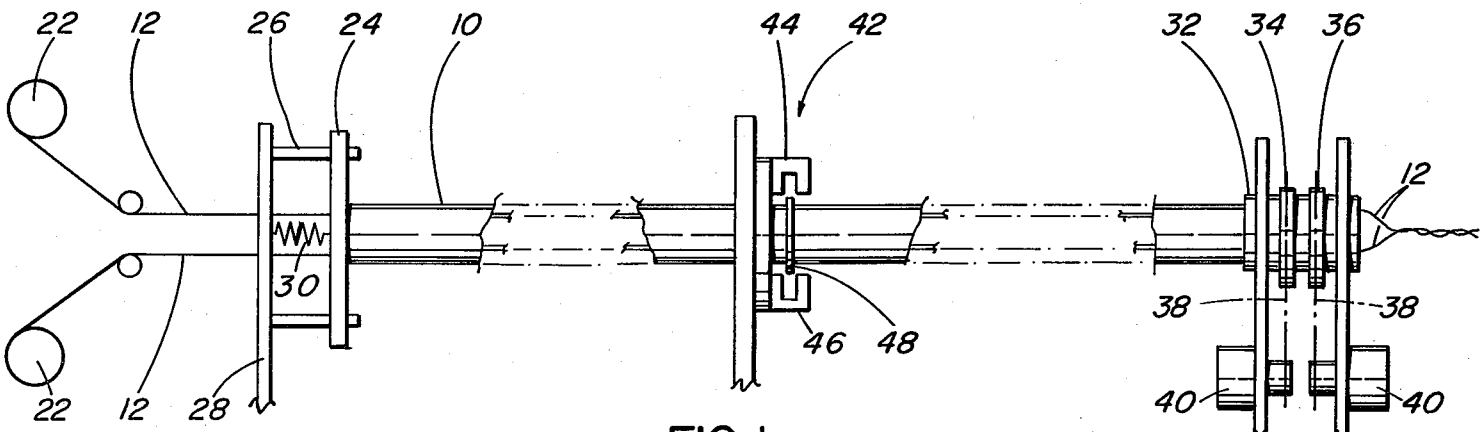
FIG. 1 is a side elevational view partly in cross-section of apparatus according to a first embodiment.
Figure 2:
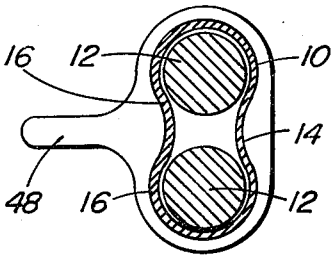
FIG. 2 is a cross-sectional view taken along line 'II-II' in FIG. 1 and on a larger scale.

The apparatus as shown in FIGS. 1 and 2 comprises a tube 10 formed from stainless steel or from an acetal homopolymer as sold under the Trademark "DELRIN". The tube is of generally figure eight shape in that it has a passage which in cross-section, is wider at each side than along the centre where there is a restriction 14 in the width of the passage. Each side 15 of the passage provides a feedpath for an insulated electrical conductor or wire 12. The tube is formed from two partly circular, arcuately formed, longitudinally extending strips 16 of the material of the tube and these strips have been joined along their center line in any suitable manner, such as by metal joining or plastic joining methods. As may be seen from FIG. 2, the restriction 14 to the passage is formed because each strip 18 extends for an angle greater than 180° around a center of its arc so that each arcuate shape is generally U-shaped with the free ends converging.

The tube is disposed within apparatus to extend along a feedpath for two wires 12 which are to be fed from spools 22. The tube is held at its upstream end by a holding means to hold the tube against rotation. This holding means comprises a tube support plate 24 which carries the upstream end of the tube 10 in a complementary hole formed within the plate. The plate 24 is slidably received in the axial direction of the tube upon two parallel guides 26 which are mounted in an upstream position to a fixed frame member 28. By this means the plate 24 is movable in the axial direction of the tubes. The plate is resiliently urged towards the frame 28 by means of two tension springs 30 extending between the plate and the frame as shown by FIG. 1. The springs 30 are superposed one upon the other in FIG. 1, whereby only one spring is shown.

At the downstream end of the tube 10, a twisting means is provided for twisting the tube alternately in one direction and then in the other about a longitudinal axis which lies substantially centrally of the cross-sectional tube shape in FIG. 2. This twisting means comprises a cylinder 32 with a hole formed to securely receive the downstream end of the tube. Two annular electric clutches 34 and 36 have their driven sides secured to the cylinder for driving the cylinder alternately in opposite directions. Each clutch is drivable by a drive belt 38 continuously driven by an electric motor 40 which forms a rotating means for rotating the cylinder 32. Upon rotation of one clutch or the other, the cylinder is rotated in one direction thereby carrying the downstream end of the tube with it around the axis of the tube. As the upstream end of the tube is non-rotatable, then any rotation of the downstream end imposes a twist upon the tube. Alternately, if the other clutch is operated, then the rotation of the downstream end of the tube and thus the twist, is in the opposite direction. The operation of the clutches and motors is such that the downstream end of the tube is rotated first in one direction about its equilibrium untwisted position and then in the opposite direction. The design and material of the tube are such that the tube is at least capable of completing thirty-five revolutions in each direction from its equilibrium position for a satisfactory working period without tube failure.

A direction changing means 42 is provided and this is located at a short distance downstream from the upstream end of the tube as shown in FIG. 1, i.e. at a position in which the tube rotates less than 360° around its axis for the maximum amount of turns, i.e. seventy turns at the downstream end of the tube. This direction changing means is, in fact, located at a position in which the tube turns only 90° in each direction for the thirty-five rotations at its downstream ends at each side of the equilibrium position shown in FIG. 1. This direction changing means is of similar construction to that described in copending patent application Ser. No. 413,178, titled "Apparatus For Stranding Wires" in the names of John Nicholas Garner, Jean Marc Roberge and Norbert Meilenner, filed concurrently with this present application. Briefly, the direction changing means comprises two U-shaped heads 44 and 46, each head carrying a magnet in one leg of the U for creating an electric field and inducing an electric current into a coil in the other leg. Each coil sends signals into an electric circuit (not shown), the strength of the signals dependent upon the stength of the magnetic field. The changing means also comprises a trigger device for interrupting the magnetic field around each magnet and this trigger device comprises an interrupter arm 48 shown in FIG. 1. This interrupter arm is securely attached to the tube 10 as shown by FIG. 2 so as to be rotated by it. The arm is in radial alignment with the gap within the U of each head 44 and 46 so as to move into the gap as rotation proceeds. Upon one of the clutches 34 or 36 rotating the downstream end of the tube in one direction, the interrupter arm rotates with the tube until it moves into a gap in one of the heads (e.g. head 46). Upon the arm reaching this position, it interrupts the magnetic field at that head and causes a change in the induced electric current into the coil. This causes a change in signal produced in the electric circuit. This change is signal effects de-energization of one of the clutches and immediate energization of the other whereby the rotational direction of the tube is simultaneously changed. Upon the tube rotating in the opposite direction, the interrupter arm moves around and eventually within the gap of the other head 44. The direction of rotation of the tube is again changed in the manner described for head 46. Hence, the downstream end of the tube is rotated for a predetermined number of revolutions alternately in one direction and the other as controlled by the direction changing means. The direction changing means 42 differs from that of the application entitled "Apparatus For Stranding Wire" in that the arm 48 rotates through a different angle, i.e. 90°, between the heads 44 and 46. Also, no damping means is provided as in the referred to application. Such damping means is found to be unnecessary with a tube of the construction of tube 10.

In use of the apparatus described in the first embodiment, the insulated conductors are passed one into each side of the tube, as shown in FIGS. 1 and 2, and pass along the tube and out through the cylinder 32. Upon rotation of the downstream end of the tube alternately in one direction and then the other for the predetermined number of revolutions, the conductors are twisted so as to strand together after leving cylinder 32. Twist applied to the tube effects a twist in the passage and prevents the conductors from twisting together upstream of cylinder 32. However, a separation tube may extend downstream from the cylinder 32 to prevent the wires from stranding together until they reach a downstream position from the cylinder.

As can be seen from the above description, the use of individual dividers or wire guiding elements is avoided in that the tube provides a continuous guide for each wire as it passes along it. It may be seen that the wires do not contact occasional guiding elements, therefore, with their attendant small and intermittent surface areas of contact. Instead, the continuous contact with the tube provides less pressure against the surface of the wire whereby any drag effect is minimized from that obtained with apparatus according to the prior application and patent as discussed.

In addition, because the two feedpaths within the tube are provided by a single passage with a restriction along its center, then each feedpath or part of the passage is open towards one side, i.e. towards the center of the tube, and at this position the wire is not contacted by the tube surface. In effect, this means that there is less area of contact by the tube at this position and thus the drag is further reduced. The wires may, in fact, touch across the restriction 14 if the design of the tube is such as to allow this to happen.

Because of the reduction in drag, the tube 10 with a length of 80 feet is capable of passing and twisting wires at a speed in excess of 500 feet/minute to result in stranded wires having approximately 2.9 inch pitch for thirty-five to forty rotations of the downstream end of the tube to each side of its equilibrium position.

Figure 3:
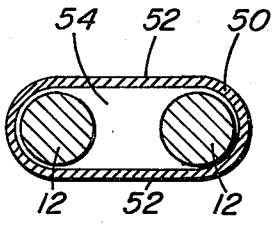
FIG. 3 is a cross-sectional view similar to FIG. 2 and of a second embodiment.

In a second embodiment as shown in FIG. 3, in apparatus which is otherwise as described in the first embodiment, the tube 10 is replaced by another tube 50 which, as shown, is a single tube which has been passed through a flattening apparatus to provide two substantially flat and parallel portions 52. In other words, the tube 50 has a widened elongate passage 54 in cross-section and this passage is of sufficient width to accomodate a predetermined outside diameter of insulated conductor while providing sufficient clearance to enable it to pass through the tube. This passage 54 will not allow two insulated conductors to interchange their positions so long as the conductors are of a suitable size to pass through the passage as has just been discussed. In a preferred arrangement with a construction of this type and to prevent the wires from becoming jammed within the passage, it would be sufficient for the passage to provide a sufficient clearance around each wire for free running along its feedpath.

The construction described in the second embodiment has the same advantages as discussed for the first embodiment.

What is claimed is:

1. Apparatus for stranding wire comprising:

a single tube defining a single axial passage which provides at least two side-by-side feedpaths for wire along the passage, the passage shaped to prevent wires from moving from feedpath to feedpath, the tube being rotationally flexible about an axis to torsionally twist the tube and thus the passage around said axis from an untwisted position so as to cause the feedpaths to follow a helical path around the axis;

holding means to hold the tube against rotation about said axis at an upstream position of the tube;

wire twisting means at the downstream position of the tube to torsionally twist the tube, the twisting means rotatable with the downstream part of the tube, said feedpaths extending through the twisting means;

rotating means for rotating the twisting means together with the downstream part of the tube for a predetermined number of revolutions about the axis alternately in one direction and then the other;

direction changing means to change the direction of rotation of the twisting means after the twisting means has rotated the predetermined number of revolutions in each direction; and resilient means associated with one of the ends of the tube to enable movement of said one end in the axial direction during twisting and untwisting of the tube.

2. Apparatus according to claim 1, wherein the tube is of flattened configuration to define a passage which is elongate in a lateral cross-section.

3. Apparatus according to claim 1, wherein the tube is formed from two longitudinal sections, each of arcuate shape and of generally 'U' configuration with the ends of each 'U' being closer together than a space defined within the 'U' and with the two sections joined together at the free ends of the 'U' shapes to define a restriction between the spaces defined within the 'U' shapes.

* * * * *